United States Patent [19]

Botzem et al.

[11] 4,447,730

[45] May 8, 1984

[54] TRANSPORTATION AND/OR STORAGE CONTAINERS FOR RADIOACTIVE MATERIALS

[75] Inventors: Werner Botzem, Alzenau; Ortwin Knappe; Reiner Laug, both of Hanau, all of Fed. Rep. of Germany

[73] Assignee: Transnuklear GmbH, Hanau, Fed. Rep. of Germany

[21] Appl. No.: 282,014

[22] Filed: Jul. 10, 1981

[30] Foreign Application Priority Data

Nov. 7, 1980 [DE] Fed. Rep. of Germany ... 8018594[U]

[51] Int. Cl.[3] ..... G21F 5/00

[52] U.S. Cl. ..... 250/506.1; 376/272

[58] Field of Search ..... 250/506.1, 507.1; 376/272

[56] References Cited

U.S. PATENT DOCUMENTS 3,780,306 12/1973 Anderson et al. ..... 250/428

4,147,938 4/1979 Heckman et al. ..... 250/506.1

*Primary Examiner*—Bruce C. Anderson

*Attorney, Agent, or Firm*—Cushman, Darby & Cushman

[57] ABSTRACT

A transportation container for radioactive materials, especially for irradiated fuel elements, has a cylindrical body of a material to shield gammaradiation. The exterior of the body is provided with spaced cooling ribs. In order to avoid the continuation of the crack into the container body occasioned by damage to the cooling ribs, as by a fall, the body is provided with spaced flanges, of lesser height than the ribs, extending transversely of and to and between the ribs so that any cracking or breaking off of a cooling rib will not occur at its base.

7 Claims, 4 Drawing Figures

TRANSPORTATION AND/OR STORAGE CONTAINERS FOR RADIOACTIVE MATERIALS

BACKGROUND OF THE INVENTION

This invention relates to an improved transportation and/or storage container for radioactive substances, especially for irradiated fuel elements from nuclear reactors.

Containers which are used for the transportation and/or storage of spent nuclear elements must safely enclose the radioactivity of such elements and ensure such safe enclosure even in the event of an extreme accident. Such containers not only must shield or prevent exterior emissions of the gamma- and n-radiation being given off by radioactive decomposition reactions of such elements but also must transfer safely to the outside the heat generated by such reactions.

Known containers, as disclosed for example by the German patent OS No. 22 28 026, have open-top thick-walled metallic container bodies closed by a thick metallic removable cover to ensure the necessary strength and shielding against gamma rays. The bodies are provided with exterior cooling ribs or fins and shielding against neutrons.

Commercial requirements for such containers specify that they must withstand severe accidents, such as a fall onto a hard surface from a height of 9 meters, so as to remain tight with no appreciable structural weakening of the container body. In such a fall, the cooling ribs or fins of the container would experience damage.

These prior containers have a number of disadvantages. Among such is the fact that in containers having welded-on or cast-on cooling ribs, there exists the danger in the case of an accident, for example, a container is dropped and cracks or breaks off one or more cooling ribs, that a crack may continue into the container body, representing the tight enclosure of the radioactive substance.

BRIEF SUMMARY OF THE INVENTION

Therefore, it is an object of the present invention to create an improved transportation and/or storage container for radioactive substances, especially for irradiated fuel elements from nuclear reactors.

It is another object of this invention to provide such a container with cooling ribs and means for minimizing the possibility of a rib crack continuing into the body of the container.

The foregoing objects are accomplished by an open-top thick-walled metallic container body provided with spaced exterior cooling ribs and spaced flanges of lesser height than the ribs interconnecting the latter to inhibit crack off of a rib at its base, i.e., at the container's outer surface, and so minimize the continuation of a rib crack into the container's body. Neutron shielding material is located conveniently between the ribs and the flanges.

Other objects and advantages of the invention will become evident from the following description and accompanying drawings in which:

DETAILED DESCRIPTION OF THE INVENTION

Figure 1:
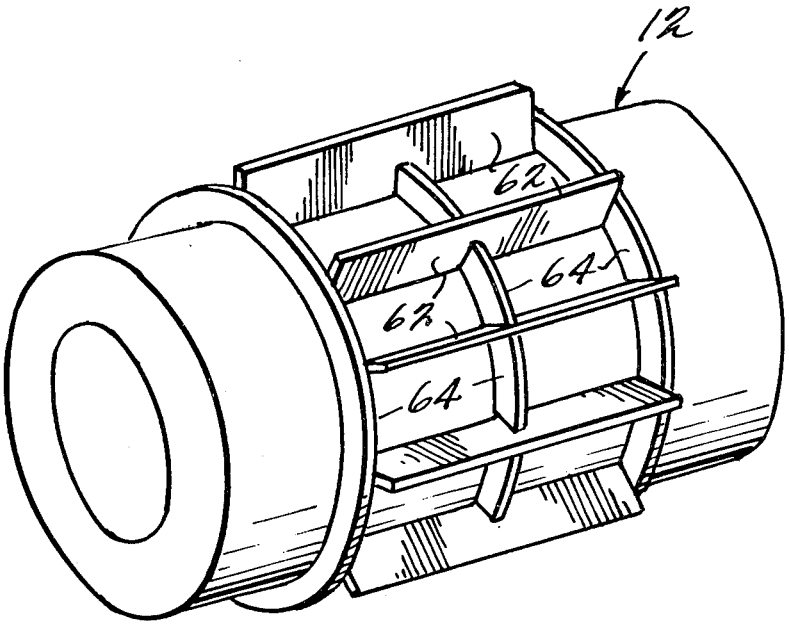
FIG. 1 is a perspective schematic view of a container embodying this invention.
Figure 2:
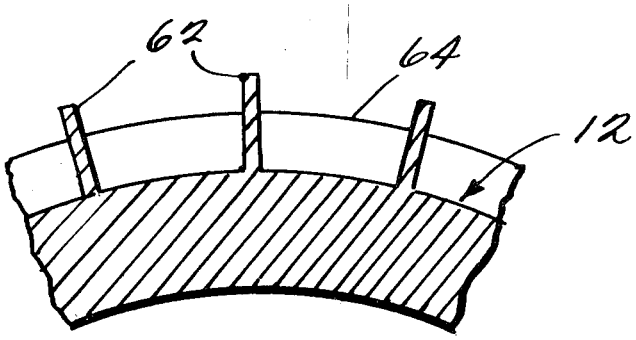
FIG. 2 is an enlarged fragmentary horizontal sectional view of the wall and exterior cooling ribs of the container body shown in FIG. 1.
Figure 3:
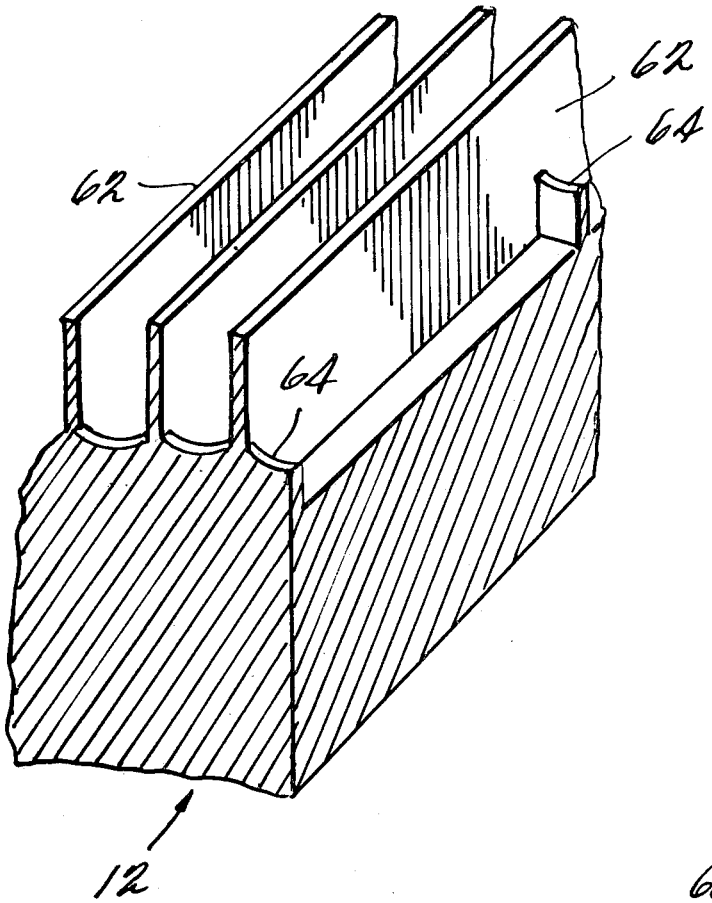
FIG. 3 is an enlarged fragmentary perspective view, partly in section, of the container shown in FIG. 1.

Referring now to the drawings, a transportation and/or storage container embodying this invention comprises mainly a thick-wall container body 12 of metallic material for containing therein and shielding gamma radiation of radioactive material. Such a container is described in the copending application of Botzem et al, Ser. No. 282,015 filed July 10, 1981, and assigned to the same assignee as this application. The disclosure of that application is incorporated by reference herein. The material of the body 12 desirably is made of cast iron, preferably spherical graphite cast iron. The container body 12 preferably is cylindrical and is provided with a plurality of preferably equally-spaced exterior cooling ribs 62 which may be arranged longitudinally, as shown, or circumferentially. These ribs 62 may be either cast integrally with the body 12 or welded thereto. Extending transversely to and between the ribs 62 and secured to the latter and to the exterior of the container body 12 are bridges or flanges 64 of a height less than that of the cooling ribs. These flanges 64 preferably are cast integrally with the body 12 and ribs 62, or they may be welded in place.

The presence of the flanges 64 insures that in the event of the breaking off or cracking off of a cooling rib 62, the line of fracture of such rib is not located at its base but at a distance above such base. This minimizes the possibility that the breaking off or cracking off of a rib 62, which may occur in the event the container is dropped, will extend the fracture into the container body 12, i.e., insures against the continuation of such a crack into the container body. The safe distance of such a rib crack from the container body 12 itself can be insured by the judicious selection of relative heights of the flanges 64 and the ribs 62. Theoretical calculations, and also experiments, have shown that it is desirable to proportion the parts such that the height of the flanges 64 is no more than about two-thirds of the height of the cooling ribs 62 and that the spacing between flanges is no more than about ten times their height.

Figure 4:
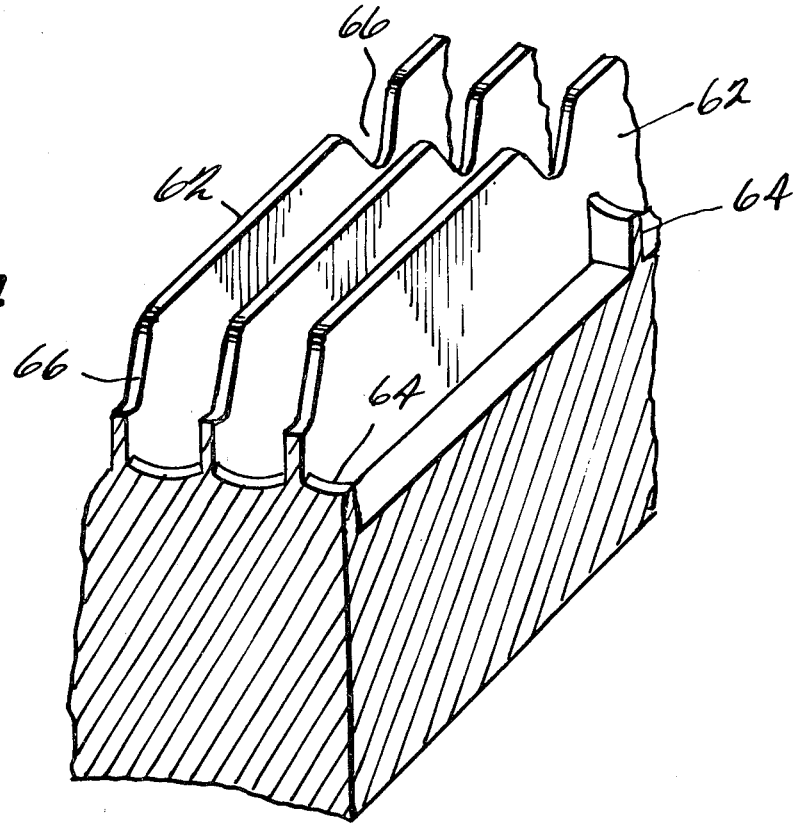
FIG. 4 is a view corresponding to FIG. 3 showing a modification of the invention.

In connection with the foregoing provision for inhibiting the extension of rib fracture cracks into the body 12 of the container, it has been found to be advantageous to provide notches 66 in the cooling ribs 62 in the area of intersection therewith of the flanges 64, as shown in FIG. 4. This construction even better insures against continuation of a rib crack into the body 12 of the container. The bottom of the notches 66 is no deeper than the tops of the flanges 64. Notches 66 of lesser depths are effective for their intended purpose, however, depending upon the specific design and material of the ribs 62 and the flanges 64. Such notches 66 may be molded by a casting operation or formed by a machining operation.

In a working example, a cast body container for irradiated nuclear fuel elements taken from a pressurized water reactor, the container having cast on longitudinal cooling ribs and circumferential flanges, may have a flange spacing of the order of about 440 mm and a flange height of about 70 mm. The cooling ribs may have a height of about 240 mm with notches therein, at the location of intersection of the flanges, of a depth of the order of about 95 mm. With these dimensions, potential cracks in the container body 12, occasioned by damage to the cooling ribs, will be avoided.

Neutron shielding material (not shown) desirably covers the cylindrical outer surface of the container body 12, preferably being disposed between the cooling ribs 62 in the spaces between the flanges 64 and the ribs.

We claim:

1. A transportation and/or storage container for radioactive substances, especially for irradiated fuel elements from nuclear reactors comprising:

a thick-walled integrally-cast metallic cylindrical body for shielding gamma radiation from radioactive substances carried therein;

a plurality of spaced generally parallel cooling ribs on the outer cylindrical surface of said body and extending radially outward thereof; and a plurality of generally parallel flanges on said outer surface extending radially outward thereof and generally transversely of and to and between said ribs, said flanges being spaced along said ribs and of lesser height than said ribs, whereby in the event of accidental fracture or breaking of a rib, the fracture line occurs above the rib base to prevent continuation of a fracture into said body of the container.

2. The structure defined in claim 1 wherein the height of the flanges is no more than the order of $\frac{2}{3}$ of the height of the ribs.

3. The structure defined in claim 1 wherein the spacing between flanges is no more than the order of 10 times their height.

4. The structure defined in claim 1 wherein the ribs have notches in the outer edges thereof at the locations of the intersections with the flanges.

5. The structure defined in claim 1 wherein the bottom of each notch substantially coincides with the height of the flanges.

6. The structure defined in claim 1 wherein the space formed by the flanges and the cooling ribs is filled with neutron shielding material.

7. The structure defined in claim 1 wherein the body, the ribs and the flanges comprise an integral casting.

* * * * *

UNITED STATES PATENT AND TRADEMARK OFFICE

CERTIFICATE OF CORRECTION

PATENT NO. : 4,447,730

DATED : May 8, 1984

INVENTOR(S) : Werner Botzem; Ortwin Knappe; Reiner Laug

It is certified that error appears in the above—identified patent and that said Letters Patent is hereby corrected as shown below:

On the title page under [30] Foreign Application Priority Data, change priority date from "Nov. 7, 1980" to -- July 11, 1980 -- .

Signed and Sealed this

*Twenty-third* Day of *October 1984*

[SEAL]

*Attest:*

GERALD J. MOSSINGHOFF

*Attesting Officer*

*Commissioner of Patents and Trademarks*